US008633448B1

(12) United States Patent
Wu et al.

(10) Patent No.: US 8,633,448 B1
(45) Date of Patent: Jan. 21, 2014

(54) MICRO-MACHINED GASEOUS RADIATION DETECTORS

(75) Inventors: Steve (Shuyun) Wu, Acton, MA (US); Jing Zhao, Winchester, MA (US)

(73) Assignee: Agiltron, Inc., Woburn, MA (US)

( * ) Notice: Subject to any disclaimer, the term of this patent is extended or adjusted under 35 U.S.C. 154(b) by 0 days.

(21) Appl. No.: 13/467,664

(22) Filed: May 9, 2012

Related U.S. Application Data

(60) Provisional application No. 61/457,677, filed on May 10, 2011.

(51) Int. Cl.
*H01J 47/00* (2006.01)

(52) U.S. Cl.
USPC ..... 250/374

(58) Field of Classification Search
USPC ..... 250/374
See application file for complete search history.

(56) References Cited

U.S. PATENT DOCUMENTS 3,407,299 A 10/1968 Jehle
3,646,381 A 2/1972 Panther et al.
4,019,057 A * 4/1977 Bram ..... 250/375
4,359,661 A 11/1982 Mitrofanov
6,133,575 A * 10/2000 Charpak et al. ..... 250/385.1

OTHER PUBLICATIONS

Jiang, S.B. Micro-Anode Guided Electroplating (MAGE) Control System with Digital Imaging Enhancement, 2006 IEEE International Conference on Systems, Man, and Cybernetics, Oct. 2006, 3233-3236.
Park, J. High aspect ratio 3-D electroplating assisted by localized laser irradiation, 2010 5th IEEE International Conference on Nano/Micro Engineered and Molecular Systems (NEMS), Jan. 2010, 1120-1123.
Madden, J.D. et al. Three-dimensional microfabrication by localized electrochemical deposition, Journal of Microelectromechanical Systems 5(1), Mar. 1996, 24-32.
Chen, T.-C. The Development of a Real-Time Image Guided Micro Electroplating System, Int. J. Electrochem. Sci. 5 (2010), 1810-1820.
Lin, J.C. Fabrication of a micrometer Ni—Cu alloy column coupled with a Cu micro-column for thermal measurement, J. Micromech. Microeng. 19 (2009) 015030, 1-11.

* cited by examiner

*Primary Examiner* — Kiho Kim
(74) *Attorney, Agent, or Firm* — Burns & Levinson LLP; Jacob N. Erlich; Orlando Lopez

(57) ABSTRACT

Micro-machined gaseous radiation detector that includes arrays of micro scale detector cells which have a small distance between the anode and cathode and require lower voltages.

18 Claims, 12 Drawing Sheets

FIGS. 3a-b

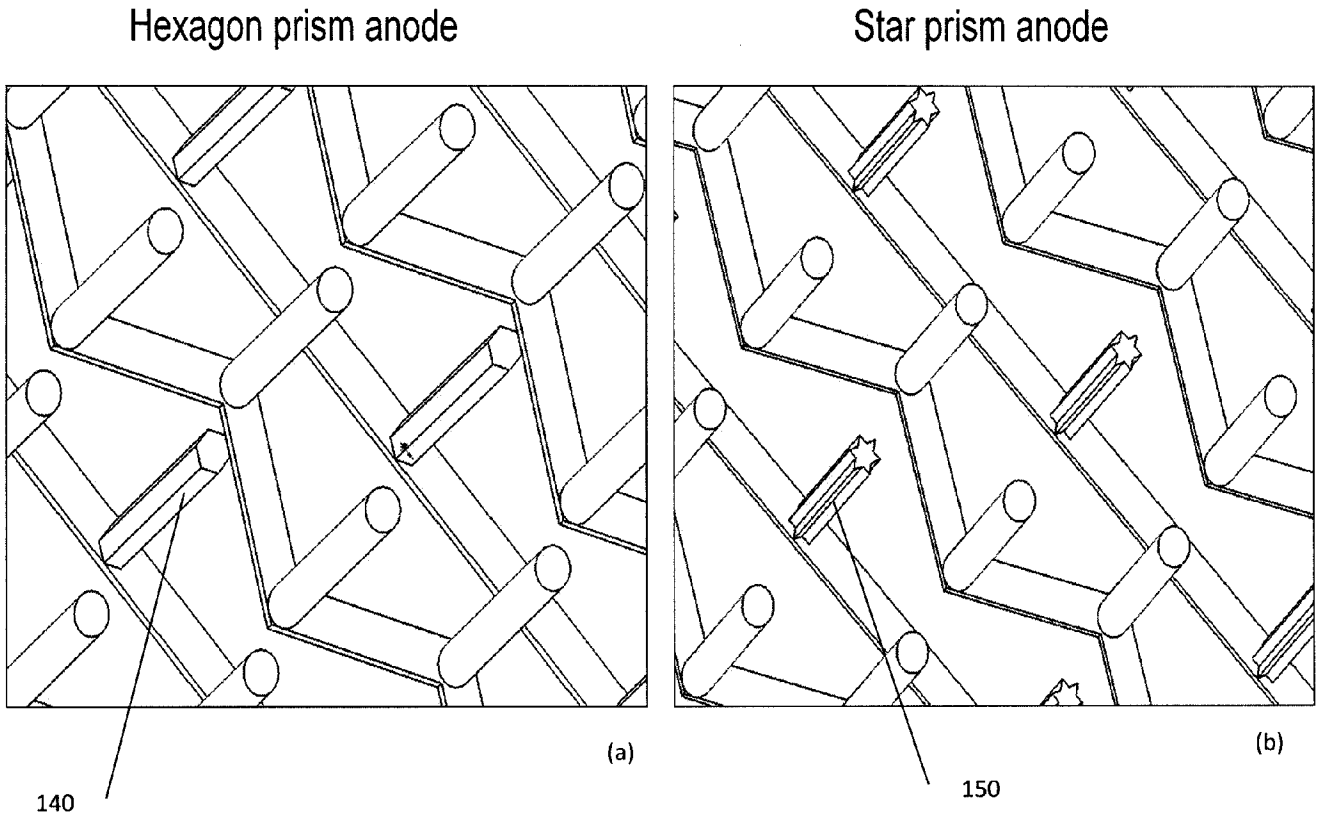
FIGS. 5a-b

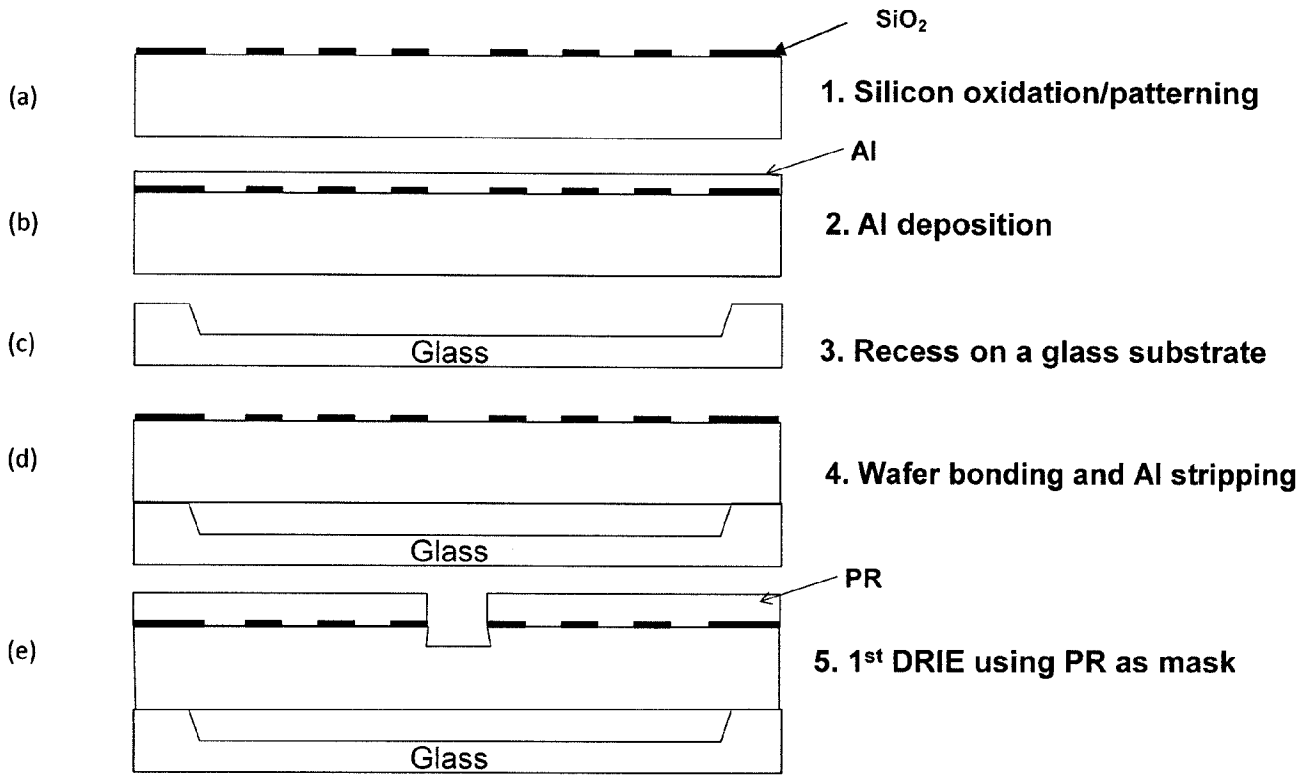
FIGS. 6a-e

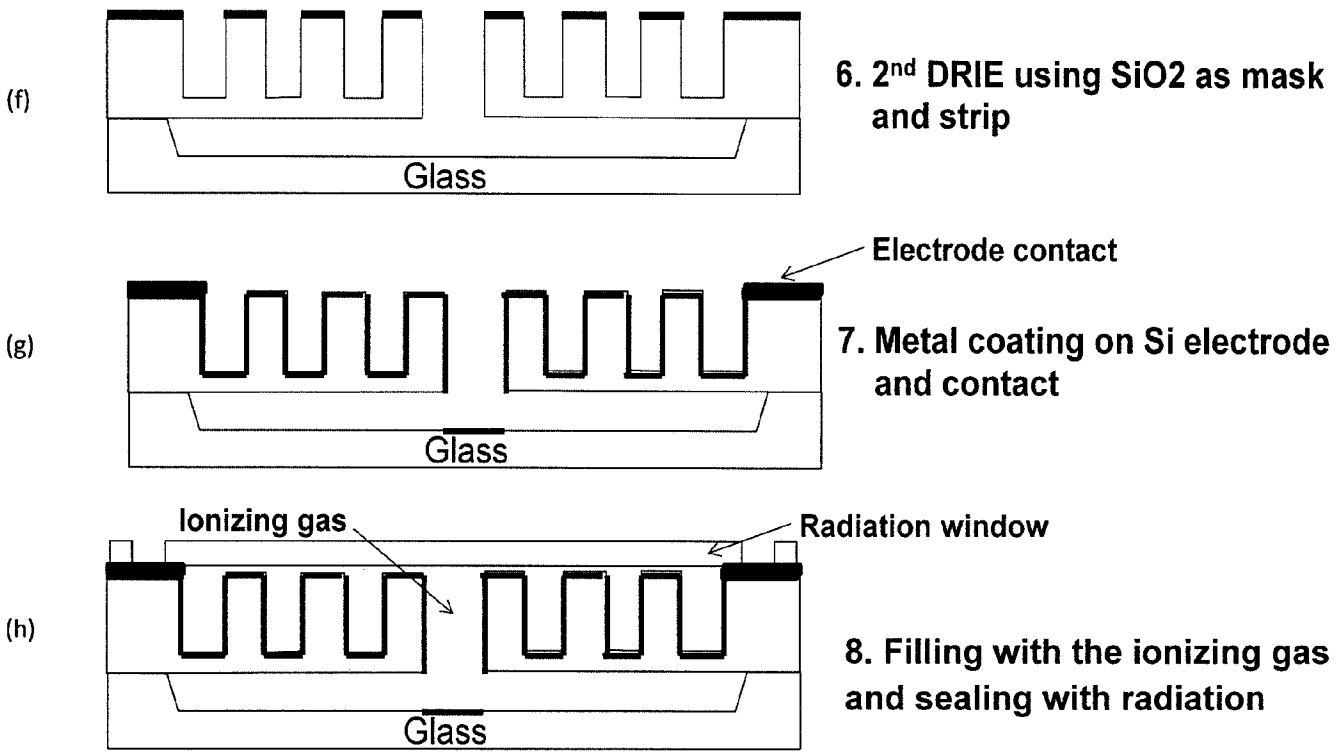
FIGS. 6f-h

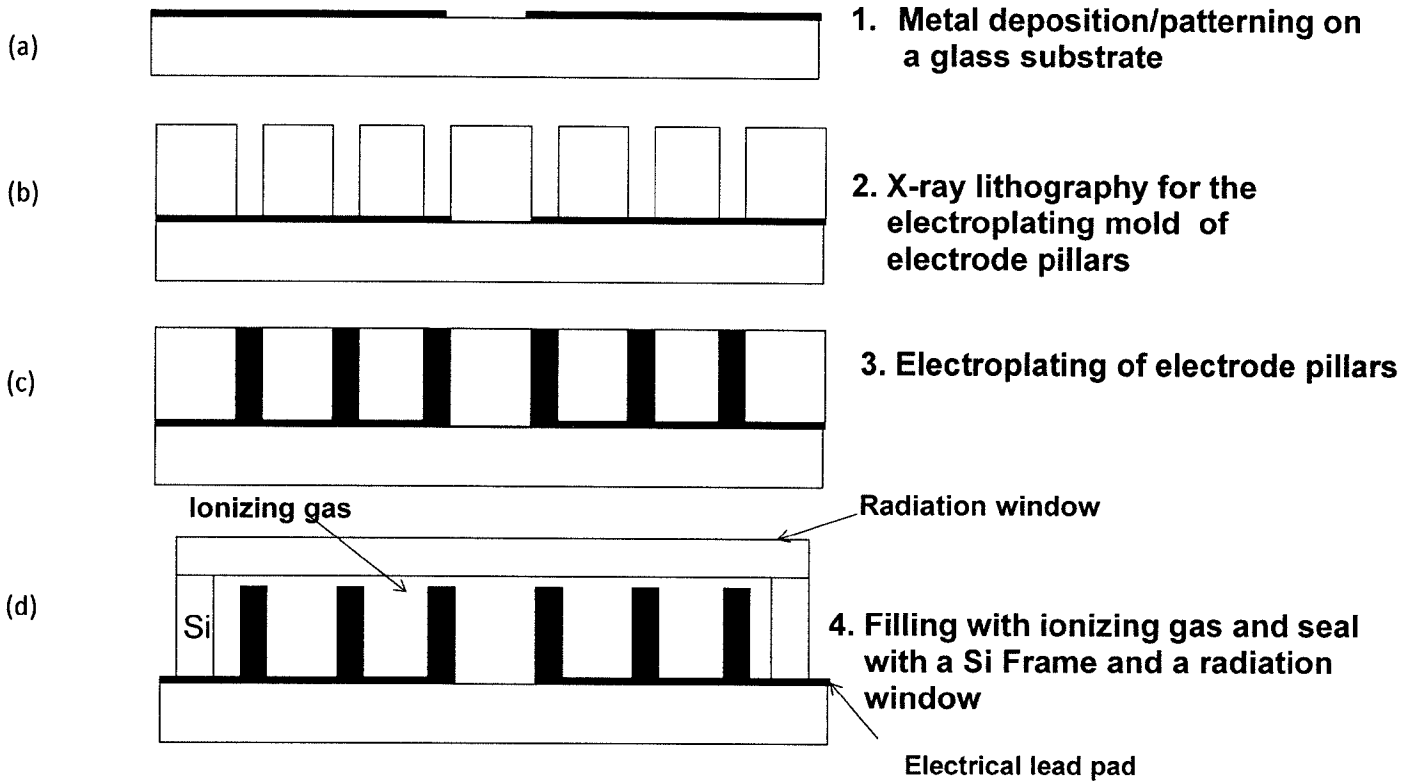
FIGS. 7a-d

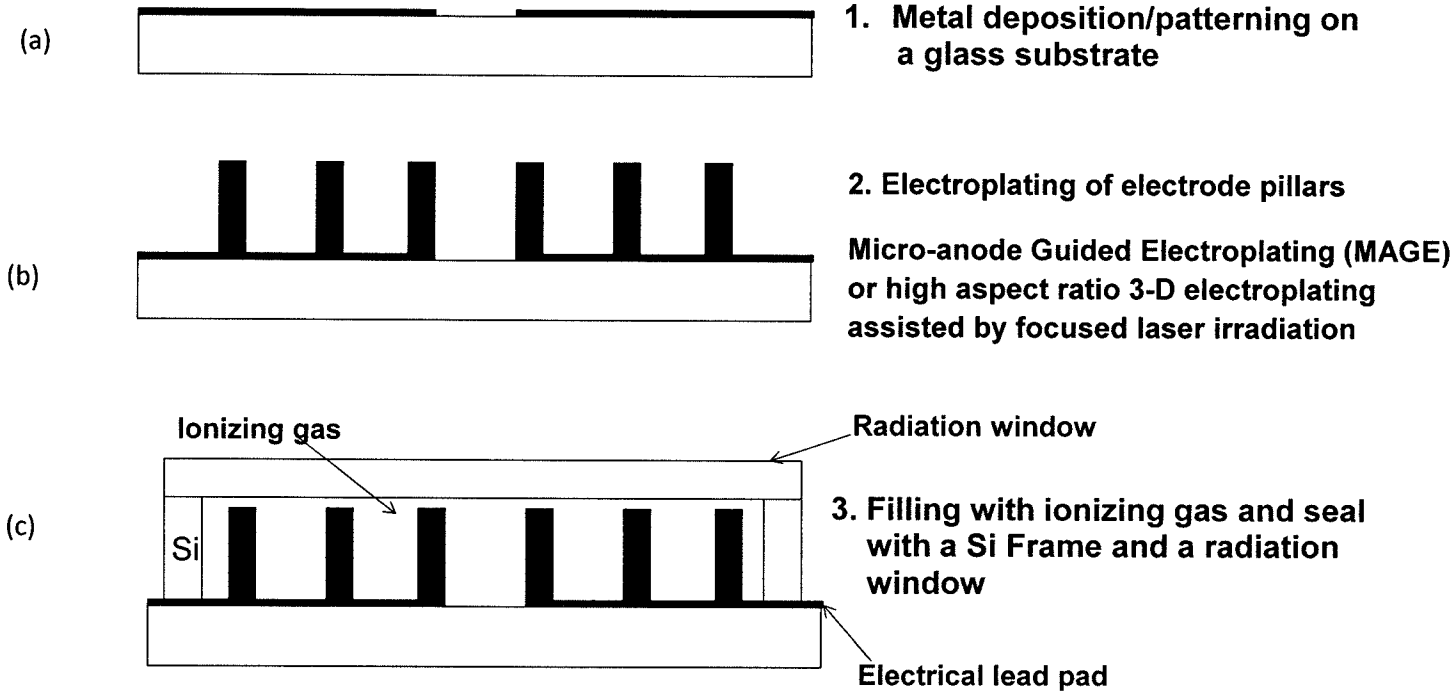
FIGS. 8a-c

MICRO-MACHINED GASEOUS RADIATION DETECTORS

CROSS REFERENCE TO RELATED APPLICATIONS

This application claims priority to U.S. Provisional Application Ser. No. 61/457,677, filed May 10, 2011, entitled, "MICRO-MACHINED GASEOUS RADIATION DETECTORS," which is incorporated by reference herein in its entirety for all purposes.

BACKGROUND

A gaseous radiation detector provides radioactive information by measuring the radioactive ionizing of gas under a strong electrical field between the anode and cathode. The ionization charge is usually multiplied by avalanches and then measured to correlate to the radiation flux and energy distribution. In some cases, the position information of radioactive ionizing can be detected by distributed anodes. The gaseous detectors are reliable, stable, easy to operate and relative inexpensive comparing to newly-developed solid state detectors, and they are still the main stream of radiation monitoring, detection and research. Typical gaseous radiation detectors include Geiger-Müller counters, Multi-Wire Proportional Chambers (MWPC), Micro-Strip Gas Chamber (MSGC), Gas Electron Multipliers (GEM), Micromegases, Time Projection Chambers (TPC) and etc. Normally their operation voltage is very high (800-2000V) which is the main barrier for the implementation of a gadget like a pocket gaseous radiation dosimeter. Such personal carrying device demands high safety, good performance, light-weight, compact size and low cost.

There is a need for gaseous radiation detectors that operate at lower voltages. There is also a need for compact size gaseous radiation detectors.

BRIEF SUMMARY

Embodiments of gaseous radiation detectors that operate at lower voltage and can be assembled in a compact size format are disclosed.

In one embodiment, the gaseous radiation detector of these teachings includes one or more cathodes, one or more anodes, each one anode being disposed a distance apart from at least one cathode, the distance being between about 50 μm to about 200 μm, the one or more cathodes and the one or more anodes being disposed in a substantially sealed chamber, a gaseous mixture being confined in the substantially sealed chamber. An electrical connection exists between the one or more cathodes and first electrical connection components accessible from an exterior surface of the substantially sealed chamber. An electrical connection exists between the one or more anodes and second electrical connection components accessible from an exterior of the substantially sealed chamber. A voltage provided between said first and at least some of the second electrical connections enables operation of the gaseous radiation detector; the voltage being between about 50 V and about 200 V.

In one embodiment, the method of these teachings for fabricating gaseous radiation detectors includes patterning the front side of a silicon wafer, the front side being patterned to define one or more anodes and one or more cathodes, forming a recess in a glass substrate, bonding the silicon wafer to the recessed glass substrate, depositing a photoresist mask on the patterned front side of the silicon wafer, deep reactive ion etching (DRIE) the front side of the silicon wafer through the photoresist mask, forming a passage from the front side to the recess in the glass substrate, deep reactive ion etching (DRIE) the front side of the silicon wafer using the pattern as a mask, thereby constituting a second DRIE of the front side of the silicon wafer, the second DRIE resulting in a at least two columnar structures, providing a metal coating on the second DRIE front side of the silicon wafer, filling the recess in the glass substrate and the columnar structures with a predetermined gaseous mixture, and sealing the front side with a radiation window.

In another embodiment, the method of these teachings for fabricating gaseous radiation detectors includes depositing a metal film on a substrate, patterning the metal film to provide at least two separate metal areas, forming columnar conductive structures on each of the at least two separate metal areas, attaching a silicon frame to the substrate in order to form a cavity enclosing the columnar conductive structures, filling the cavity with a predetermined gaseous mixture, and sealing the cavity with a radiation window.

For a better understanding of the present teachings, together with other and further objects thereof, reference is made to the accompanying drawings and detailed description and its scope will be pointed out in the appended claims.

BRIEF DESCRIPTION OF THE DRAWINGS

FIGS. 5*a*, 5*b* are schematic representations of for one embodiment of the device of the present teachings with a sharp edged anode: a) Hexagon prism anode; b) Star prism anode;

FIGS. 6*a*-6*h* are graphic illustrations of an embodiment of a process for manufacturing devices of these teachings;

FIGS. 7*a*-7*d* are graphic illustrations of another embodiment of a process for manufacturing devices of these teachings;

FIGS. 8*a*-8*c* are graphic illustrations of yet another embodiment of the process for manufacturing devices of these teachings;

DETAILED DESCRIPTION

The following detailed description is of the best currently contemplated modes of carrying out these teachings. The description is not to be taken in a limiting sense, but is made merely for the purpose of illustrating the general principles of these teachings, since the scope of these teachings is best defined by the appended claims. Although the teachings have been described with respect to various embodiments, it should be realized these teachings are also capable of a wide variety of further and other embodiments within the spirit and scope of the appended claims.

As used herein, the singular forms "a," "an," and "the" include the plural reference unless the context clearly dictates otherwise.

Except where otherwise indicated, all numbers expressing quantities of ingredients, reaction conditions, and so forth used in the specification and claims are to be understood as being modified in all instances by the term "about."

"Honeycomb structure," as used herein, refers to a cell in a honeycomb configuration.

Embodiments of gaseous radiation detectors that operate at lower voltage and can be assembled in a compact size format are disclosed herein below.

Micro-machined gaseous radiation detector consists of arrays of micro scale detector cells which have much smaller distance between the anode and the cathode. A characteristic distance between the anode and the cathode being between about 50 microns and about 200 microns. Each cell works in the same principle as the conventional gaseous radiation detectors but with much lower operation voltage (an order of magnitude lower at least—about 50 to about 200 volts) due to the gap reduction between the electrodes. Using micromachining technology, such micro cell arrays can be batch fabricated on wafers and sealed with the ionizing gas by wafer level packaging to form small detector chips. The chips will be separated and packaged with detection circuits to build compact detectors. Furthermore, the micro detector cell arrays can be integrated on wafers with ASIC wafers that already have detection circuits built in. In such case, the radioactive ionizing in each cell can be indentified and the position information is obtained. In addition, the detection chips can be stacked up to increase the total detective volume to further increase the sensitivity for different applications.

Using micromachining technology, the compact and light weight detectors can be batch fabricated with the similar processes the used in IC industry in the past few decades that provides mass production with low cost. The low operation voltage increases the user safety and further lowers down the cost without using high voltage electronics. Hence the innovated detector is well suited for the application of pocket gaseous radiation dosimeters.

Figure 1:
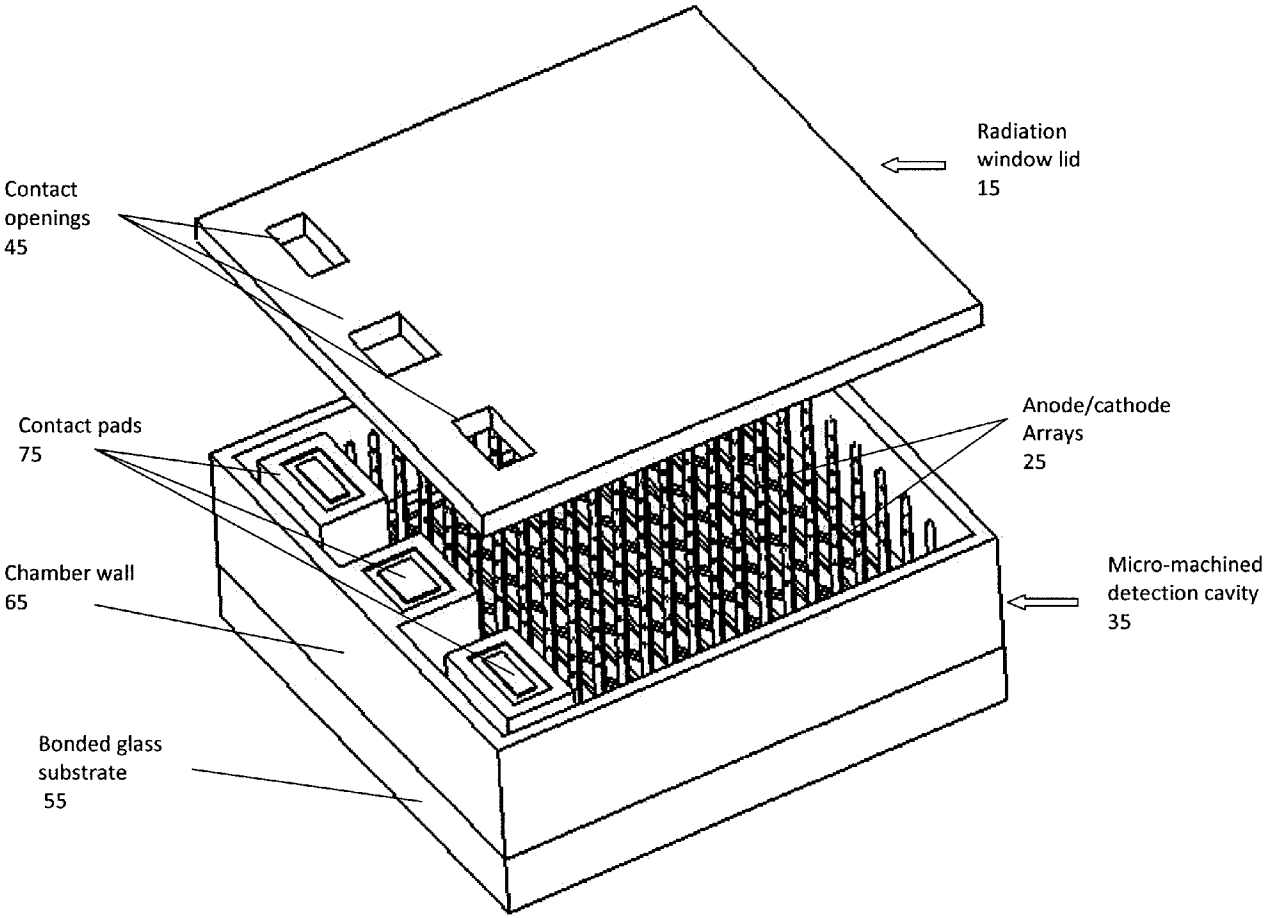
FIG. 1 is a perspective view of an opened device of the present teachings.

FIG. 1 is a perspective view of an opened device of the present invention. The radiation window lid 15 is bonded to the micro-machined detection cavity 35 to seal the ionizing gas inside. The micro-machined detection cavity includes a substrate 55 on which an electrode array 25 is disposed and chamber walls 65. Through openings 45 of the lid, a voltage can be applied to the contact pads 75 that connect to the electrode arrays 25 in the cavity 35, and then ionizing charge can be measured to determine the radiation that enters the cavity through the window lid. In one embodiment, these teachings not being limited to only that embodiment, the ionizing gas includes mixture of gases such as argon, a halogen quenching gas such as bromine and an inert gas such as neon. In one instance, the mixture typically contains approximately 0.1% argon and 1 to 2% bromine with the remainder neon.

Figure 2:
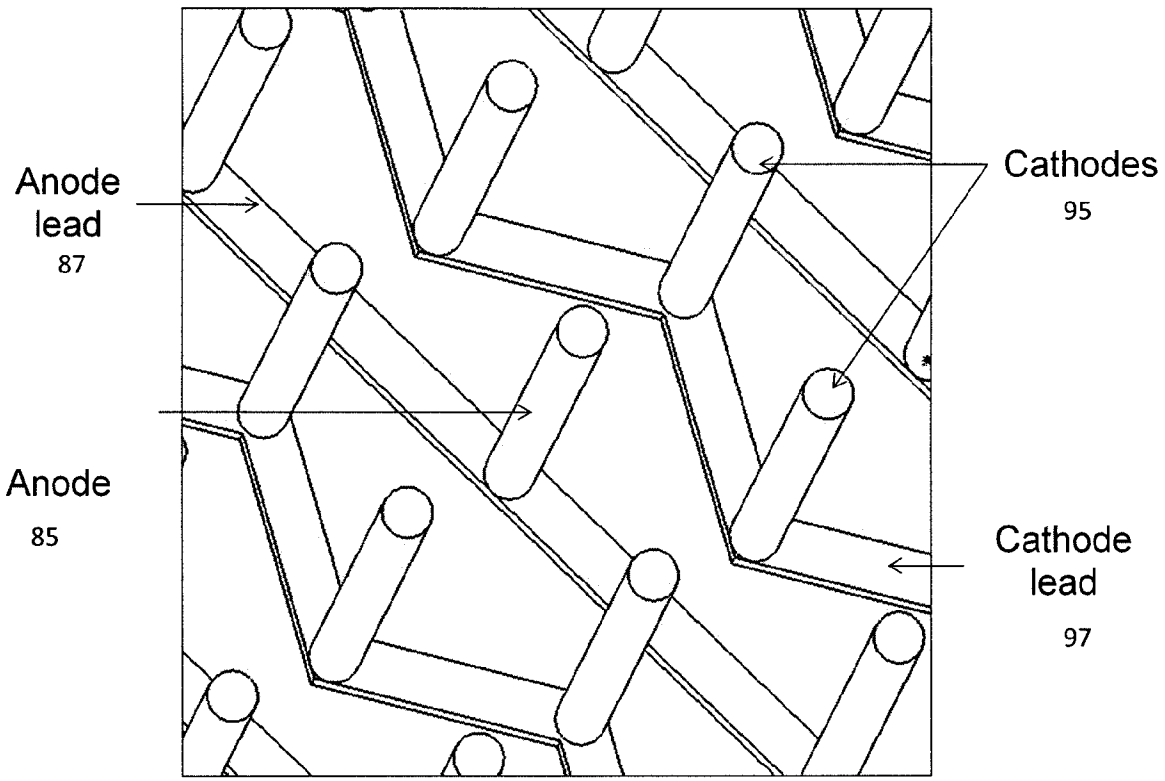
FIG. 2 is the zoomed view of micro electrode post arrays inside a detection cavity for one embodiment of the device of the present teachings.

FIG. 2 is the zoomed view of micro electrode post arrays inside the cavity. Each anode post 85 is surrounded by cathodes 95 to form a basic detection cell. Anode leads 87 provide electrical connection to the anodes and cathode leads 97 provide electrical connection to the cathodes. A strong electrical field (>1 kV/cm) built between the voltage applied anode and cathodes drives the radiation ionizing charge towards to the anode. The charge multiplies nearby the anode where the electrical field gets above 50 kV/cm and eventually is collected to the anode. The charge avalanche multiplication can be controlled in a proportional amplification region and hence the energy information of radiation particles can be detected according to the collection at the anode.

Figure 3:
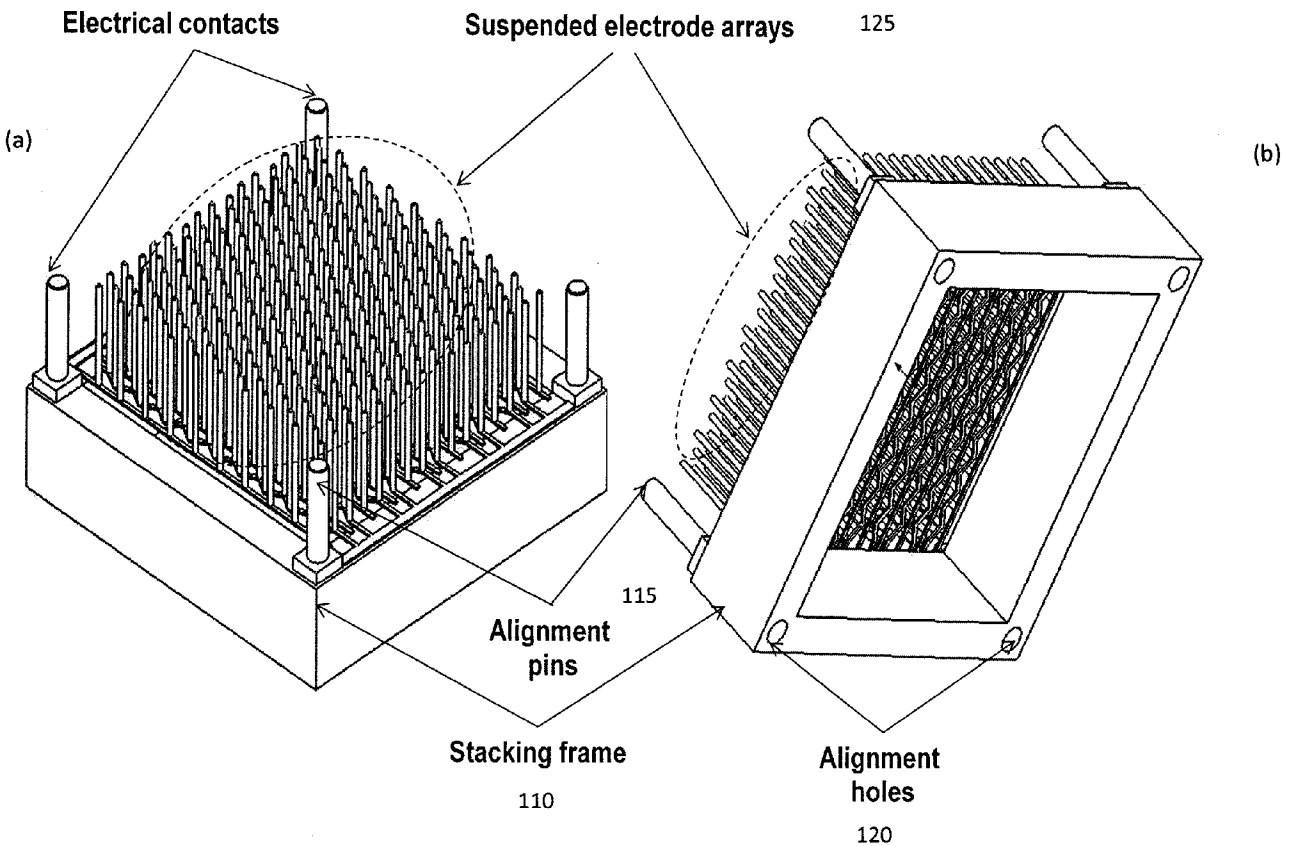
FIGS. 3*a*, 3*b* are top and bottom perspective views of a stacking micro-machined module for one embodiment of the device of the present teachings.

FIGS. 3*a*, 3*b* show the top and bottom perspective views of a stacking micro-machined module of the invention. The electrode arrays 125 are suspended on the stacking frame 110 which has 4 alignment holes 120. By aligning the alignment pins into the alignment holes, one module can stack on another module. The alignment the pins serve as electrical connection between the stacking modules. The total detection volume is proportional to the number of detection modules.

Figure 4:
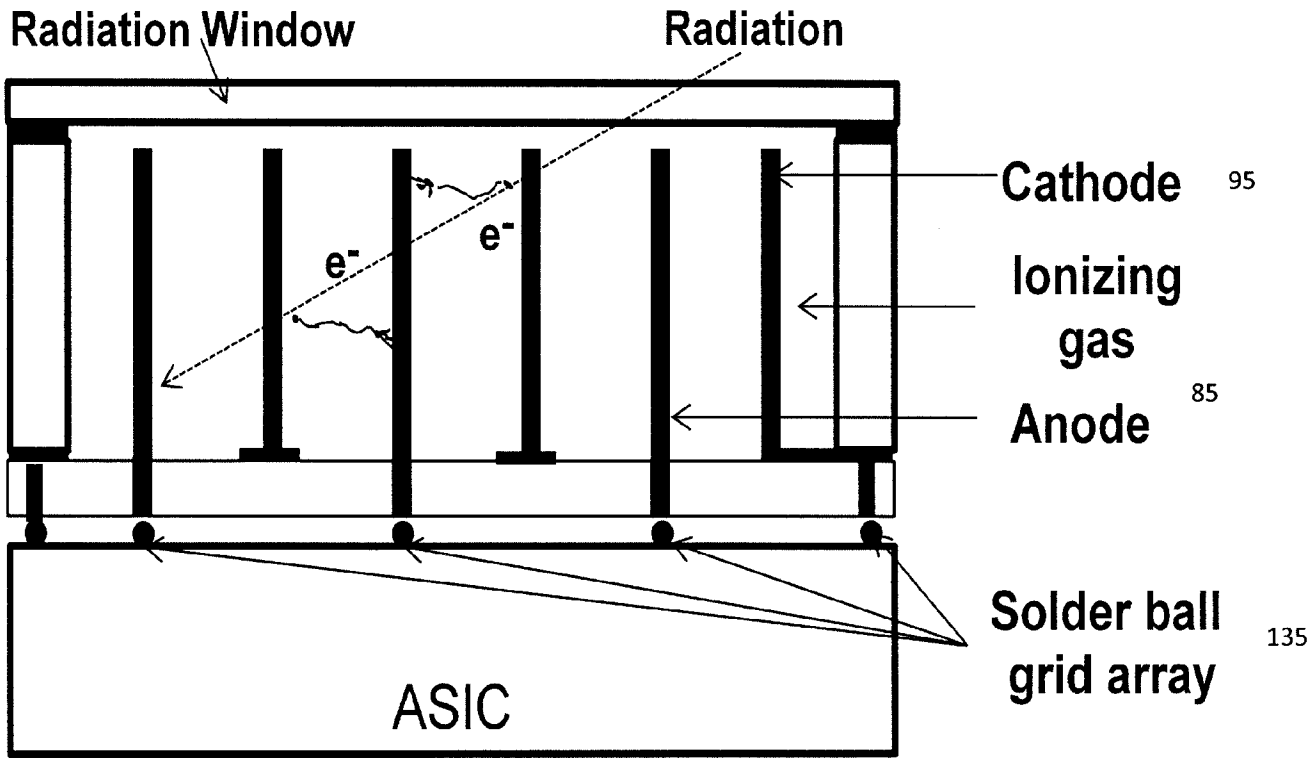
FIG. 4 is a schematic representation of vertical integration of micro-machined detector to ASIC with Solder ball grid array for one embodiment of the device of the present teachings.

FIG. 4 illustrates the vertical integration of micro-machined detector to an ASIC with Solder ball grid array 135. While the common cathodes 95 are connected together, each anode 85 can be connected to an ASIC through via and solder. Hence the radiation charge within each detection cell can be collected and measured through a unit circuit in the ASIC chip faster and more precisely. In such way, more accurate information of both radiation energy and ionizing position can be obtained.

In addition to the round post, anodes can be made with sharp edges like hexagon 140 or star prism 150 as shown in FIG. 5. Around the sharp edges, the electrical fiend is greatly intensified to achieve the field strength required for an avalanche multiplication even at a lower operation voltage.

In another embodiment of the gaseous radiation detector of these teachings, honeycomb walls and frame serve as cathodes and posts are for the anodes, each post being located substantially in a center of one of said one or more honeycomb structures. In one instance, the honeycomb structures include silicon honeycomb structures and the posts include silicon posts. In another instance, each post has one or more metal films disposed over the post and each honeycomb structure has one or more metal films disposed over at least a surface of the honeycomb structure opposite the post located substantially in the center of each honeycomb structure.

Figure 9A:
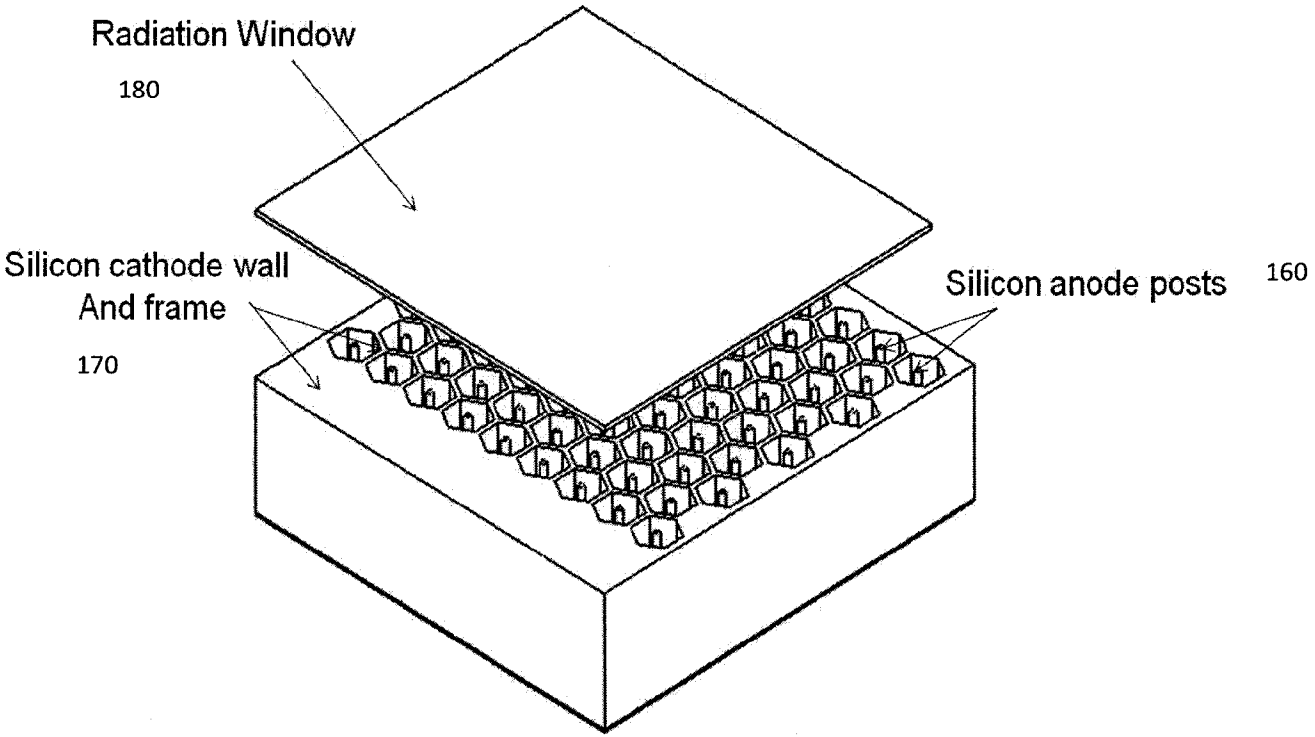
FIGS. 9*a*, 9*b* are schematic representations of for one embodiment of the device of the present teachings with integrated honeycomb detection cells.
Figure 9B:
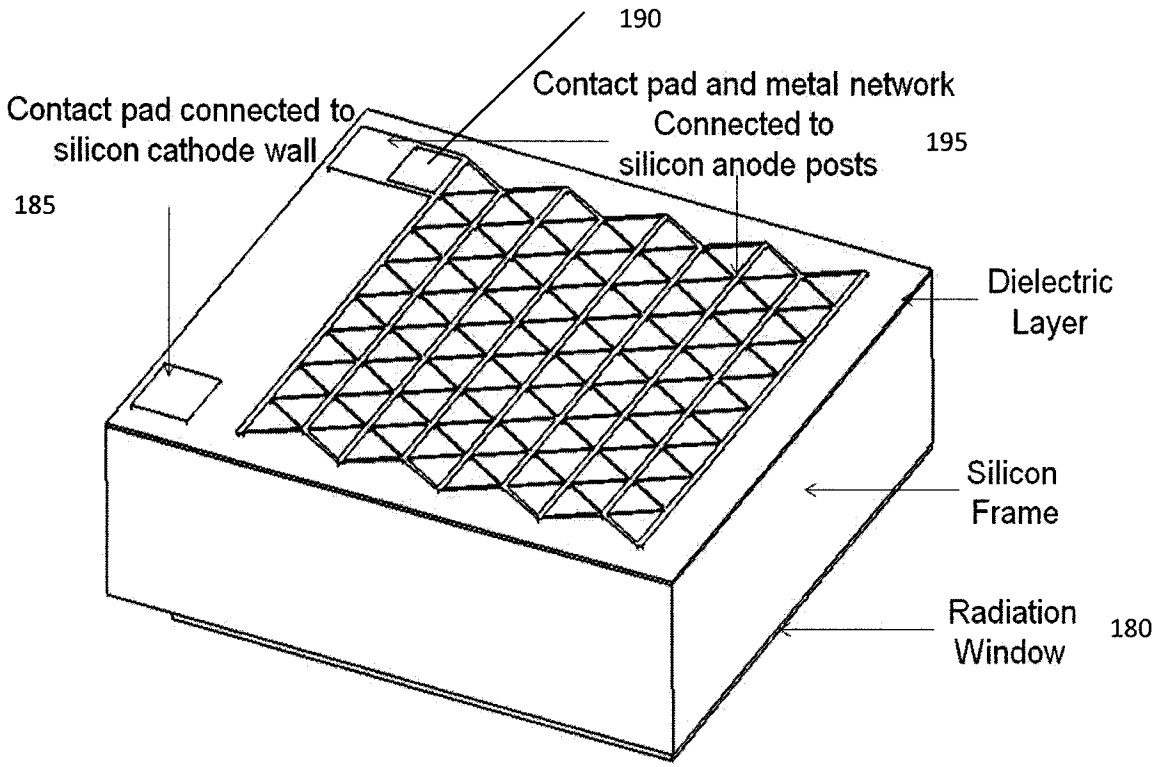

An embodiment of the gaseous radiation detector of these teachings in which honeycomb walls and frame serve as cathodes and posts are for the anodes is shown in FIGS. 9*a* and 9*b*. Referring to FIGS. 9*a* and 9*b*, the silicon honeycomb wall and frame 170 serve as cathode and silicon posts 160 serve as the anodes. The anode posts 160 are connect to a metal network 195 and bonding pad 190 through the openings on the backside dielectric film stack while the cathode walls and frame 170 are connected to the other bonding pad 185 through an opening on the dielectric film stack as well. The surface of the cathode walls and anode posts 170, 160 are coated with metal film stack to prevent the surface oxidation of the silicon. A radiation window 180 seals the cavities filled with ionization gas.

There are a few micromachining methods to precisely fabricate the anode and cathode array. The methods include, but are not limited to, Deep Reactive Ion Etch (DRIE), LIGA, Micro-Anode Guided Electroplating (MAGE) (see, for example, J. C. Lin et al., Fabrication of a micrometer Ni—Cu alloy column coupled with a Cu micro-column for thermal measurement, J. Micromech. Microeng., 19 (2009) 015030, incorporated by reference herein in its entirety for all purposes) and high aspect ratio 3-D electroplating assisted by focused laser irradiation (see, for example, J. Park, H. Kim, "High aspect ratio 3-D electroplating assisted by localized laser irradiation," Proceedings of the 2010 5th IEEE International Conference on Nano/Micro Engineered and Molecular Systems Jan. 20-23, 2010, Xiamen, China, incorporated by reference herein in its entirety for all purposes).

In one embodiment, the method of these teachings for fabricating gaseous radiation detectors includes patterning the front side of a silicon wafer, the front side being patterned to define one or more anodes and one or more cathodes, forming a recess in a glass substrate, bonding the silicon wafer to the recessed glass substrate, depositing a photoresist mask on the patterned front side of the silicon wafer, deep reactive ion etching (DRIE) the front side of the silicon wafer through the photoresist mask, forming a passage from the front side to the recess in the glass substrate, deep reactive ion etching (DRIE) the front side of the silicon wafer using the pattern as a mask, thereby constituting a second DRIE of the front side of the silicon wafer, the second DRIE resulting in at least two columnar structures, providing a metal coating on the second DRIE front side of the silicon wafer, filling the recess in the glass substrate and the columnar structures with a predetermined gaseous mixture, and sealing the front side with a radiation window.

In one instance, the method disclosed herein above also includes depositing, before bonding, a metal film on the patterned front side and removing, after bonding, the deposited metal film. In one instance, these teachings not being limited to only that instance, the metal film is aluminum.

One embodiment of the process flow is shown in FIGS. 6*a*-6*h*. The process starts, as shown in FIG. 6 (*a*), with patterning the front side of the silicon substrate, the pattern being formed in $SiO_2$ (oxidized silicon), proceeding to FIG. 6 (*b*), showing a metal film being deposited on the patterned front side, then, as shown in FIG. 6 (*c*), a recess is formed in a glass substrate. FIG. 6 (*d*) shows bonding of the back side of the silicon substrate and the glass substrate, followed by removing the metal film. FIG. 6 (*e*) shows the deposition of a photoresist mask on the patterned surface, the photoresist is used as a mask for the first DRIE, producing at least two separate structures. FIG. 6 (*f*) shows the results of the second DRIE using the $SiO_2$ pattern as a mask, resulting in at least two columnar structures. As shown in FIG. 6(*g*), a metal coating is deposited on the silicon structures and, as shown in FIG. 6(*h*), the structures and the recess in the glass substrate are filled with a predetermined gas mixture and the cavity is sealed with a radiation window, forming the radiation detector.

In another embodiment, the method of these teachings for fabricating gaseous radiation detectors includes depositing a metal film on a substrate, patterning the metal film to provide at least two separate metal areas, forming columnar conductive structures on each of the at least two separate metal areas, attaching a silicon frame to the substrate in order to form a cavity enclosing the columnar conductive structures, filling the cavity with a predetermined gaseous mixture and sealing the cavity with a radiation window.

In one instance, forming the columnar conductive structures on each of the at least two separate metal areas is performed by the LIGA (Lithographie Galvanoformung Adformung) technique and includes forming a mask for x-ray lithography, the mask providing openings to define the columnar conductive structures, depositing on the metal film and exposed substrate a developable material (such as, but not limited to, PMMA), exposing the developable material through the mask in order to form a mold for the columnar conductive structures, electroplating to fill the mold and form the columnar conductive structures and removing the remaining developable material.

One instance of the method disclosed hereinabove is shown in FIGS. 7*a*-7*d*. The method starts, as shown in FIG. 7*a*, by depositing a metal film on a substrate where the metal film is patterned to provide at least two separate metal areas. As shown in FIG. 7*b*, a mask for x-ray lithography is used to expose a developable material deposited on the metal film and exposed substrate, forming an electroplating mold for the columnar conductive structures. The columnar conductive structures are electroplated, as shown in FIG. 7*c*. A silicon frame is then used to create a cavity surrounding the columnar conductive structures, the cavity is filled with a predetermined gas mixture and is sealed with a radiation window, as shown in FIG. 7*d*.

In another instance, forming the columnar conductive structures on each of the at least two separate metal areas is performed by electroplating the columnar conductive structures. The electroplating can be performed by Micro-Anode Guided Electroplating (MAGE) or by high aspect ratio 3-D electroplating assisted by focused laser irradiation.

One instance of the method applying MAGE or high aspect ratio 3-D electroplating assisted by focused laser irradiation is shown in FIGS. 8*a*-8*c*. The method starts, as shown in FIG. 8*a*, by depositing a metal film on a substrate where the metal film is patterned to provide at least two separate metal areas. The columnar conductive structures are electroplated by Micro-Anode Guided Electroplating (MAGE) or by high aspect ratio 3-D electroplating assisted by focused laser irradiation, as shown in FIG. 8*b*. A silicon frame is then used to create a cavity surrounding the columnar conductive structures, the cavity is filled with a predetermined gas mixture and is sealed with a radiation window, as shown in FIG. 8*c*.

In another embodiment, the method of these teachings for fabricating gaseous radiation detectors includes growing a silicon oxide layer on a front surface and a back surface of a silicon substrate, coating the front surface and the back surface of the silicon substrate with a silicon nitride layer, patterning contact holes through the silicon nitride layer on the back surface, depositing metal leads protruding through and substantially filing each contact hole, patterning a metallization structure connecting at least some of the metal leads, deep reactive ion etching (DRIE), through a mask, the front surface and forming posts and honeycomb structures, each post being located substantially in the center of one honeycomb structure, depositing a metal film over the posts and at least part of the honeycomb structures, filling space between the posts and the honeycomb structures with a predetermined gaseous mixture and sealing the front surface with a radiation window.

Figures 10A, 10B, 10C, 10D, 10E, 10F, 10G:
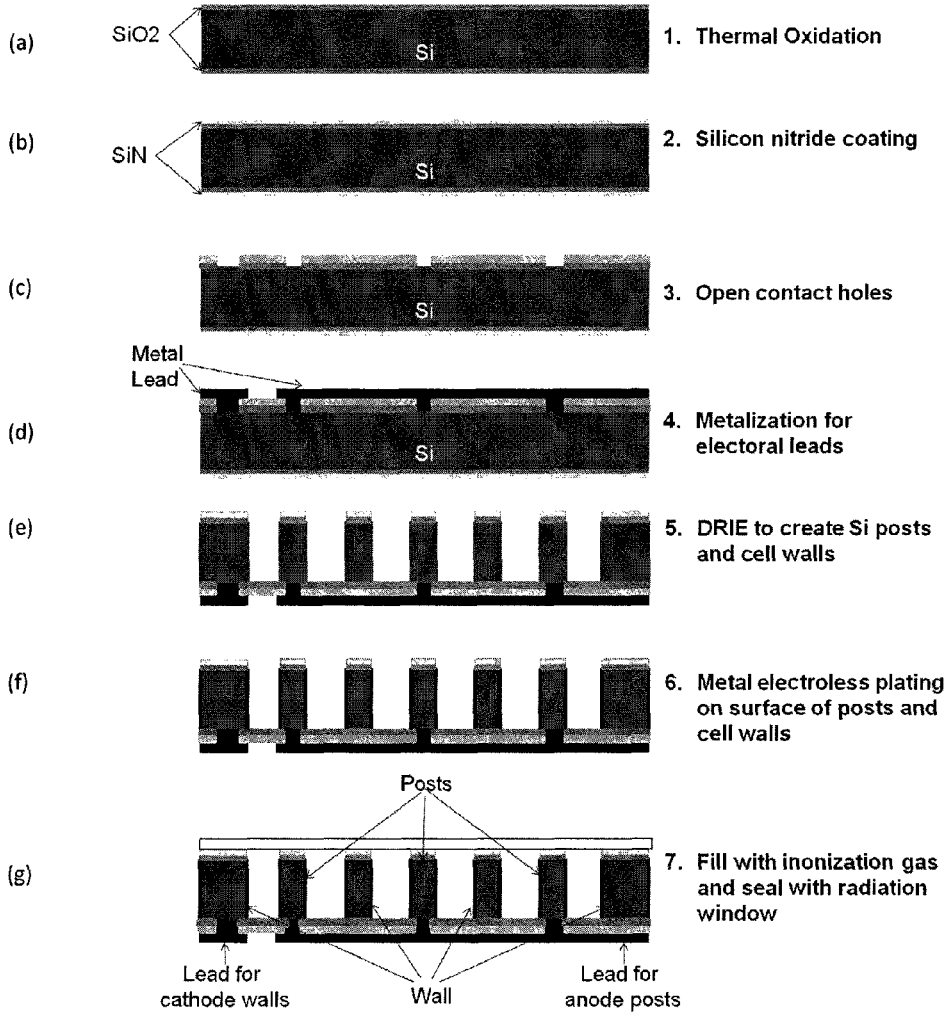
FIGS. 10*a*-10*g* are graphic illustrations of a further embodiment of the process for manufacturing devices of these teachings.

One instance of the method disclosed hereinabove is shown in FIGS. 10*a*-10*g*. Referring to FIGS. 10*a*-10*g*, silicon dioxide is grown thermally on a front and back surfaces of a highly P-type silicon wafer (FIG. 10*a*) followed by the coating of silicon nitride on the silicon dioxide (FIG. 10*b*). Subsequently, contact holes are etched into the stack of silicon dioxide and silicon nitride at the back surface (FIG. 10*c*) and the lead metal film is deposited into and protruding from the contact holes (FIG. 10*d*) and a metallization is patterned (FIG. 10*d*). The post anodes are connected to the metal network and a bonding pad and the frame cathode is connected to the other bonding pad. Then the cavity is formed by silicon etching the wafer from the other side (FIG. 10*e*). A conductive and protective metal stack is deposited over the posts and at least part of the honeycomb structures (FIG. 10*f*). Finally the wafer is filled with ionization gas and the ionization chamber sealed with the radiation window (FIG. 10*g*).

For the purposes of describing and defining the present teachings, it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Although the invention has been described with respect to various embodiments, it should be realized these teachings are also capable of a wide variety of further and other embodiments within the spirit and scope of the appended claims.

What is claimed is:

1. A gaseous radiation detector comprising:

one or more cathodes; and one or more anodes;

each one anode being disposed a distance apart from at least one cathode;

said distance being between about 50 μm to about 200 μm;

said one or more cathodes and said one or more anodes being disposed in a substantially sealed chamber;

a gaseous mixture being confined in said substantially sealed chamber;

an electrical connection existing between said one or more cathodes and first electrical connection components accessible from an exterior of said substantially sealed chamber;

an electrical connection existing between said one or more anodes and second electrical connection components accessible from the exterior of said substantially sealed chamber;

a voltage provided between said first and at least some of said second electrical connections enabling operation of the gaseous radiation detector;

said voltage being between about 50 V and about 200 V.

2. A gaseous radiation detector comprising:

one or more cathodes; and one or more anodes;

each one anode being disposed a distance apart from at least one cathode;

said distance being between about 50 μm to about 200 μm;

said one or more cathodes and said one or more anodes being disposed in a substantially sealed chamber and spaced apart from each other at a distance;

a gaseous mixture being confined in said substantially sealed chamber;

an electrical connection existing between said one or more anodes and second electrical connection components accessible from the exterior of said substantially sealed chamber;

a voltage provided between said first and at least some of said second electrical connections enabling operation of the gaseous radiation detector;

said voltage being between about 50 V and about 200 V;

wherein said each one anode comprises electric field enhancement features.

3. The gaseous radiation detector of claim 2 wherein said electric field enhancement features are substantially sharp edges.

4. The gaseous radiation detector of claim 3 wherein said substantially sharp edges are provided by a hexagonal structure.

5. The gaseous radiation detector of claim 3 wherein said substantially sharp edges are provided by a star shaped structure.

6. The gaseous radiation detector of claim 2 wherein at least some of said second electrical connection components provide electrical connections adapted to receive an integrated circuit.

7. A gaseous radiation detector comprising:

one or more cathodes; and one or more anodes;

each one anode being disposed a distance apart from at least one cathode;

said distance being between about 50 μm to about 200 μm;

said one or more cathodes and said one or more anodes being disposed in a substantially sealed chamber and spaced apart from each other at a distance;

a gaseous mixture being confined in said substantially sealed chamber;

an electrical connection existing between said one or more anodes and second electrical connection components accessible from the exterior of said substantially sealed chamber;

a voltage provided between said first and at least some of said second electrical connections enabling operation of the gaseous radiation detector;

said voltage being between about 50 V and about 200 V;

wherein said one or more cathodes comprise one or more honeycomb structures; and wherein said one or more anodes comprise one or more posts, each post being located substantially in a center of one of said one or more honeycomb structures.

8. The gaseous radiation detector of claim 7 wherein said one or more honeycomb structures comprise one or more silicon honeycomb structures; and wherein said one or more posts comprise one or more silicon posts.

9. The gaseous radiation detector of claim 8 wherein each post from said one or more silicon posts comprises one or more metal films disposed over said each post; and wherein each honeycomb structure from said one or more honeycomb structures comprises one or more metal films disposed over at least a surface of said each honeycomb structure opposite said post located substantially in a center of said each honeycomb structure.

10. A method for fabricating a gaseous radiation detector, the method comprising the steps of:

patterning the front side of a silicon wafer; the front side being patterned to define one or more anodes and one or more cathodes;

forming a recess in a glass substrate;

bonding the silicon wafer to the recessed glass substrate;

depositing a photoresist mask on the patterned front side of the silicon wafer;

deep reactive ion etching (DRIE) the front side of the silicon wafer through the photoresist mask;

deep reactive ion etching (DRIE) the front side of the silicon wafer using the pattern as a mask, thereby constituting a second DRIE of the front side of the silicon wafer; the second DRIE resulting in a at least two columnar structures; one of the first or second DRIE forming a passage from the front side to the recess in the glass substrate;

providing a metal coating on the front side of the silicon wafer after the second DRIE;

filling the recess in the glass substrate and the columnar structures with a predetermined gaseous mixture; and sealing the front side with a radiation window.

11. The method of claim 10 further comprising depositing, before bonding, a metal film on the patterned front side; and removing, after bonding, the deposited metal film.

12. The method of claim 11 wherein the metal film is an aluminum film.

13. A method for fabricating a gaseous radiation detector, the method comprising the steps of:

depositing a metal film on a substrate;

patterning the metal film to provide at least two separate metal areas;

forming columnar conductive structures on each of the at least two separate metal areas;

attaching a silicon frame to the substrate in order to form a cavity enclosing the columnar conductive structures;

filling the cavity with a predetermined gaseous mixture; and sealing the cavity with a radiation window.

14. The method of claim 13 wherein the step of forming the columnar conductive structures comprises:

forming a mask for x-ray lithography; the mask providing openings to define the columnar conductive structures;

depositing on the metal film and exposed substrate a developable material;

exposing the developable material through the mask in order to form a mold for the columnar conductive structures;

electroplating to fill the mold and form the columnar conductive structures; and removing the remaining developable material.

15. The method of claim 13 wherein the step of forming the columnar conductive structures comprises electroplating the columnar conductive structures.

16. The method of claim 15 wherein the step of electroplating the columnar conductive structures is performed by Micro-Anode Guided Electroplating (MAGE).

17. The method of claim 15 wherein the step of electroplating the columnar conductive structures is performed by high aspect ratio 3D electroplating assisted by focused laser irradiation.

18. A method for fabricating a gaseous radiation detector, the method comprising the steps of:

growing a silicon oxide layer on a front surface and a back surface of a silicon substrate;

coating the front surface and the back surface of the silicon substrate with a silicon nitride layer;

patterning contact holes through the silicon nitride layer on the back surface;

depositing metal leads protruding through and substantially filing each contact hole and patterning a metallization structure connecting at least some of the metal leads;

deep reactive ion etching, through a mask, the front surface and forming posts and honeycomb structures; each post being located substantially in a center of one of said one or more honeycomb structures;

depositing a metal film over the posts and at least part of the honeycomb structures;

filling space between the posts and the honeycomb structures with a predetermined gaseous mixture; and sealing the front surface with a radiation window.

* * * * *